United States Patent [19]

Mathiesen

[11] Patent Number: 4,603,906

[45] Date of Patent: Aug. 5, 1986

[54] SEPARABLE PIECE OF FURNITURE

[76] Inventor: Lars Mathiesen, St. Kongensgade 110B, DK-1264 Copenhagen, Denmark

[21] Appl. No.: 731,016

[22] Filed: May 6, 1985

[30] Foreign Application Priority Data

May 11, 1984 [DK] Denmark ..... 2381/84

[51] Int. Cl.[4] ..... A47C 7/00

[52] U.S. Cl. ..... 297/440; 108/111

[58] Field of Search ..... 297/440; 108/111; 312/263, 264

[56] References Cited

U.S. PATENT DOCUMENTS

| | | | |
|---|---|---|---|
| 803,961 | 11/1905 | Andrews et al. | 297/443 |
| 1,063,086 | 5/1913 | Tietz | 312/263 |
| 2,919,816 | 1/1960 | Maslow | 108/111 |
| 3,013,670 | 12/1961 | Mayer | 108/111 |
| 3,045,831 | 7/1962 | Pendergrast | 108/111 |
| 3,101,148 | 8/1963 | Brown | 108/111 |
| 3,856,374 | 12/1974 | Christen | 312/264 |
| 3,915,097 | 10/1975 | Young | 108/111 |
| 4,209,198 | 6/1980 | Apple | 297/440 |
| 4,270,799 | 6/1981 | Flaum | 297/440 |

*Primary Examiner*—Francis K. Zugel

*Attorney, Agent, or Firm*—Antonelli, Terry & Wands

[57] ABSTRACT

In a separable lightweight armchair comprising a backpiece, two sidepieces and a seatpiece, the sidepieces are separably edge-assembled with the backpiece, in that they from a slantingly backward directed position are inserted on firm coupling parts on the backpiece, in that the coupling parts are inserted in the clearance between two parallel framewires on the sidepiece, and hereafter rotated forwards to a locking mesh with the coupling parts. The sidepieces are locked in their forwardly directed normal position by a traverse piece at the front.

9 Claims, 4 Drawing Figures

SEPARABLE PIECE OF FURNITURE

The present invention relates to a separable piece of furniture comprising panel elements made of metal pipes or wires, in which at least two such panel elements are joined or joinable edge to edge in a separable manner to enable a compact packing of the piece of furniture. The invention will be described with primary reference to an armchair, but it will be appreciated that the principles of the invention will be equally applicable to various other types of furniture such as armsofas and certain bookcases and storing systems.

Thus, the invention primarily relates to an armchair having a chassis comprising four main panel elements, viz. a chairback, a seat frame and two sidepieces, all made of metal pipes or wires. During storing and consignment of the chair these four parts can be packed in a flat box along with possible belonging cushions. The frameparts should be prepared with necessary coupling devices, and several appliances are known for this purpose, each with its own particular advantages and disadvantages. Particularly the coupling between chairback and sidepieces is critical due to its significance for the stability of the piece of furniture concerned.

The purpose of the invention is to provide a piece of furniture of the above type, which is designed in such a way that the coupling between the chairback and the sidepieces or generally between two panel elements is obtainable in a both simple and stable manner.

According to the invention, the chairback is at each side provided with an upper as well as a lower, laterally protruding coupling part made of a stiff material such as vertically positioned flat iron, which, outwardly from the side edge, is bent out first to one and then to the other side, so as to form mutually opposed sinuosities, and those edge parts of the sidepieces which are to be coupled to the chairback are shaped with or as two parallel pipes or wires which, by means of middle pieces, are positioned in a fixed distance from each other, namely sufficient to make it possible for the coupling part of the chairback to be inserted in the provided clearance between the parallel pipes or wires; the arrangement is such that this inserting can be performed with the sidepieces turned backwards from the edge of the chairback, so that the one of the parallel pipes or wire is carried inwards to form a rotary joint connection with the outermost sinuosity of the coupling parts, whereafter the chairback and the sidepiece are rotated mutually around this hinge for the turning in and subsequent positioning of the other pipe or wire in the innermost counterdirected sinuosity of the coupling parts, with which the said other pipe or wire gears by the final rotation of the sidepiece to its normal position of application. That is, in this position the sidepiece will be able to rotate relative the chairback, however, preferably only in an outward direction, this rotatability, however, will be blocked by the subsequent mounting of the seatframe on the sidepieces or by any other means for mutually stabilizing the side pieces. The main thing is that by the counter rotating of the coupling parts, a rigid butt connection is created between the coupling parts and the edge portions of the sidepieces implying that in this or these connections no play or wobble is possible in any direction. In this way a very simple manner of securing an extremely stable connection is achieved, which, however, at all times is releasable in an equally simple manner.

The mentioned parallel pipes or wires that extend along the hindmost edge of the sidepieces, can most advantageously be constituted by a section of a a sidepiece frame, which in its entirely is made up in this way. A strong frame can thus show a "light" appearance, and the ends of existing supplementary wires in the sidepieces may be welded inside the clearance between the "doublewire", so that the ends of the wires do not present any tearing effect. Based on the same reason, the chairback can advantageously be shaped similarly.

It will be understood that the above "chairback" and "sidepieces" are representative construction elements or panel members to be connected according to the invention, without the invention being limited to those representative examples.

The invention will be described in more detail in the following, reference being made to the drawing, in which.

Figure 1:
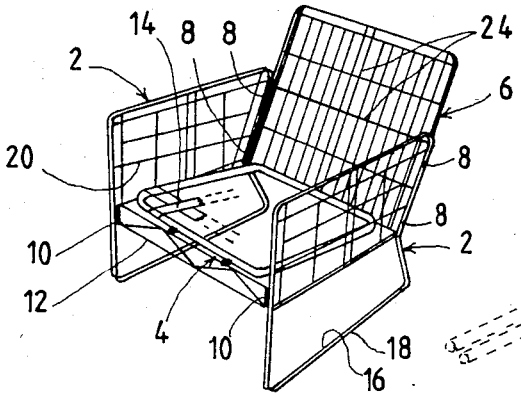
FIG. 1 is a perspective view of a chair according to the invention.

The chair as shown in FIG. 1 includes four main parts, namely two sidepieces 2, a seat frame 4 and a chairback 6. The sidepieces 2 are along their upper rear edges connected to the chairback 6 at coupling areas 8, and the seat frame 4 is detachably supported partly on the lower edge of the chairback 6 and partly on special fittings 10 on the vertical front edges of the sidepieces 2, in that the seat frame itself at its front edge is hinged to a piece of wire netting 12, which at its ends is fastened to the fittings 10, which for instance can be made from ordinary bed fittings. On the seat frame 4 webbings 14 are suspended.

Figure 2:
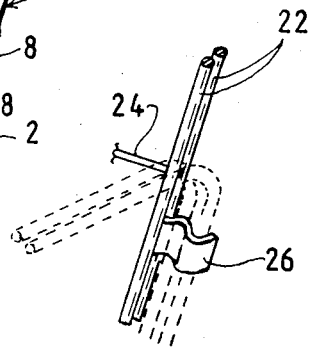
FIG. 2 is a detailed view of a coupling part on the chairback.

The sidepieces 2 are built up from a doublewire frame with two adjacent wires 16 and 18, between which the ends of various supplementary wires 20 have been installed and welded. Also the chairback 6 includes a similar doublewire frame 22 (FIGS. 2 and 3) with welded supplementary wires 24.

In each of the coupling areas 8 a protruding coupling part 26 (FIGS. 2 and 3) has been welded to the chairback frame 22 in the shape of a piece of flat iron, which is winding outwards, first to one side (backwards) and then to the other side (forwards). The thickness of this piece of iron is adjusted, so that it is just accurately insertable between the frame wires 16 and 18 in the upper rear edge of the sidepieces 2.

Figure 3:
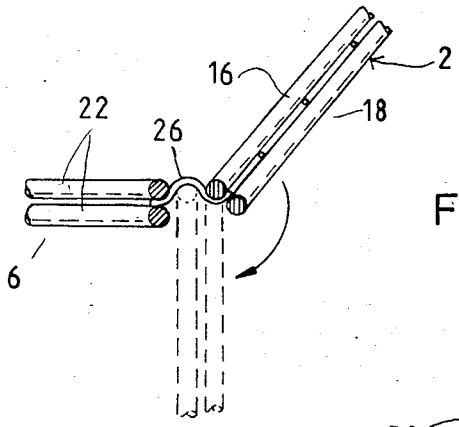
FIG. 3 is a horizontal sectional view illustrating the functioning of the coupling part.

At the time of assembly of the chair, the chairback 6 is initially connected to one of the sidepieces 2, in that, as shown in FIG. 3, the sidepiece is held turned far backwards from the edge of the chairback for the inserting of the extreme end of the coupling plate or rather both coupling plates 26 in the clearance between the parallel wires 16 and 18, whereby the wire 16 is brought to rest in the outermost winding or sinuosity of the plate 26. Hereafter the side part 2 is turned forwards around the centered wire 16, as shown with the curved arrow in FIG. 3, whereby the wire 18 will be inserted in the innermost sinuosity of the plate 26 just when the sidepart 2 is perpendicularly protruding from the chairback 6, this position being indicated in dotted lines FIGS. 2 and 3, respectively.

Thereafter, when the other sidepiece has been mounted in a similar manner, the rear edge of the seat frame 4 is fastened to the lower edge of the chairback 6, and the wire netting 12 at the front is fastened to the supporting fittings 10, whereafter the chair can be lined with cushions.

By the rotating of the sidepieces 2 into their final mounted positions, the wires 16 and 18 will gear into a very rigid clutch with the coupling parts 26 in that the wires will be effectively locked, preventing displacement both laterally and in forward and backward directions, that is, the concerned hinge areas will be outmost stable and free of play and wobbling.

If desired, of course, the coupling plates 26 can be mounted on the sidepieces 2 instead of on the chairback 6 as long as the latter offers a doublewire frame or a similar device, at least in the relevant mesh areas.

The mentioned doublewire frame or frames are important in providing the piece of furniture with a "light" appearance.

Another important feature of the concerned piece of furniture is that the front part of the seatframe is made up by a part of wire netting 12, which, built as a light structure, is suitable for carrying the front edge of the seatframe. This part appears with a certain height between its upper and lower edges, and when a seat and backcushion is installed in the chair (or in a similarly built sofa), this cushion can have a front part, which at its front edge is adapted to be bent downwards and then backwards around the lower edge of the wire netting 12, that is, inwards and underneath the seatframe 4 for the fastening to this or possibly to the lower edge of the chairback 6. In that the frontside of the cushion in this way is extended downwardly along the wire netting 12, an aesthetical appearance is obtained, that matches the appearance of an upholstered piece of furniture, which in itself is an essential innovation of a piece of furniture that has been built up by thin metal wires.

Figure 4:
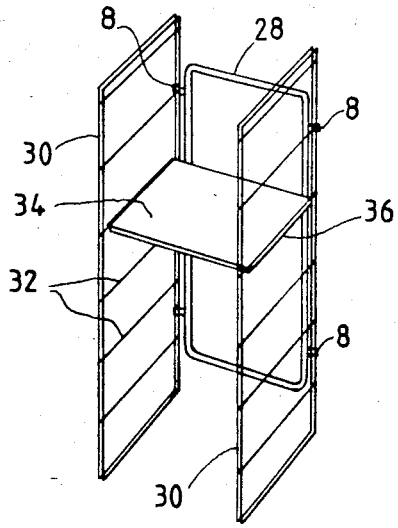
FIG. 4 is a perspective view of another piece of furniture according to the invention.

In FIG. 4 is shown another piece of furniture, viz. a shelf stand in which, compared with FIG. 1, a rear frame 28 corresponds to the backrest 6, while two opposed side panels 30 correspond to the support and armrest members 2 and are connected with the frame 28 in the manner described above, by coupling parts 26 engaging with the twin wire frame system of the side panels 30. Cross wires 32 of the side panels are usable as support means for a number of shelves 34, of which only one is shown. Each shelf has, along each of its side edges, a hook rail 36 engaging over the respective cross wire, whereby the entire structure is stabilized.

Of course, the side panels should not necessarily be parallel in their mounted positions, when only the directions of the coupling parts 26 are adjusted accordingly. It is even possible to arrange the coupling parts in such a manner that they are operable to couple two panel elements such that these project flush with each other.

The panel elements should not necessarily be of the double wire frame type as discussed above, when only the relevant joining areas are provided with holding portions operable to cooperate with the coupling parts in the manner shown and described. Thus, with these holding portions of the element 2 arranged as illustrated in FIG. 3 relative the coupling part 26, the panel element itself could well be orientated, relative to its holding portions, perpendicularly to its direction as shown in FIG. 3.

What is claimed is:

1. A separable piece of furniture comprising a first and a second panel element which are joinable edge to edge in a separable manner, characterized in that the first panel element is provided with a freely protruding coupling part, which is outwardly wound first to one and then to an opposite side so as to form mutually opposed sinuosities, and that the edge portion of the second panel element as connected with said coupling part includes two parallel pipe holding portions, which are cast substantially apart just sufficiently to enable the coupling part to be inserted, relatively, into and through the clearance between the holding portions and, by a relative rotation of the two panel elements about one of the holding portions as hereby being rested in the outermost of said sinuosities, enable the other of said holding portions to be brought into a butting engagement with the innermost sinuosity of the coupling part.

2. A piece of furniture according to claim 1, in which said parallel holding portions are formed by one of pipes and wires forming a frame structure of said second panel element.

3. A piece of furniture according to claim 2, in which one panel element is a rear furniture portion, to each of the opposed side edges of which is secured, by more of said coupling parts, a side wall panel projecting forwardly from the rear furniture portion, with opposed side wall panel adjacent their foremost portions being interconnected by a removable connector element holding the side wall panels in such positions, in which the holding portions thereof are in a butting engagement with the sinuosities of the respective coupling parts.

4. A piece of furniture according to claim 1, in which one panel element is connected, along opposite side edges thereof, with two mutually opposed side panel elements, a rigid member is arranged in a space between the two side elements so as to stabilize the mutual positions of the three panel elements.

5. A piece of furniture according to claim 4, and constructed as one of an armchair and an armsofa, characterized in that the side panel elements adjacent front edges thereof are releasably interconnected by a front carrier member, to which is pivotally secured a seat frame, a rear edge of which is provided with means for being suspended on a lower carrier portion of a backrest element.

6. A piece of furniture according to claim 4, wherein said rigid member is a rigid frame.

7. A piece of furniture according to claim 4, wherein said rigid member is a plate-shaped member.

8. A piece of furniture according to claim 3, wherein the rear furniture portion is a rear wall member.

9. A piece of furniture according to claim 3, wherein the rear furniture portion is a backrest member.

* * * * *